US006367434B1

(12) United States Patent
Steigerwald et al.

(10) Patent No.: US 6,367,434 B1
(45) Date of Patent: Apr. 9, 2002

(54) SOLENOID VALVE, PARTICULARLY A PROPORTIONAL HYDRAULIC VALVE

(75) Inventors: Martin Steigerwald; Jens Schäfer; Matthias Dohr, all of Herzogenaurach (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/711,193

(22) Filed: Nov. 13, 2000

(30) Foreign Application Priority Data

Nov. 23, 1999 (DE) ..... 199 56 160

(51) Int. Cl.[7] ..... F01L 1/34

(52) U.S. Cl. ..... 123/90.15; 251/129.15; 137/625.65

(58) Field of Search ..... 251/129.15; 137/315.03, 137/625.65; 123/90.11, 90.12, 90.15, 90.16, 90.17, 90.18

(56) References Cited

U.S. PATENT DOCUMENTS

| | | | | |
|---|---|---|---|---|
| 4,423,841 A | * | 1/1984 | Palma | 239/585 |
| 4,790,345 A | | 12/1988 | Kolchinsky | |
| 5,364,067 A | * | 11/1994 | Linkner | 251/129.02 |
| 5,820,099 A | * | 10/1998 | Rahbar | 251/129.15 |
| 5,848,613 A | * | 12/1998 | Sakaguchi | 137/625.65 |
| 6,129,062 A | * | 10/2000 | Koda | 123/90.17 |
| 6,145,540 A | * | 11/2000 | Linkner | 137/625.65 |

FOREIGN PATENT DOCUMENTS

| | | |
|---|---|---|
| DE | 3416337 | 11/1985 |
| DE | 90171071 | 5/1992 |
| DE | 19537656 | 5/1996 |
| DE | 19717445 | 10/1998 |
| EP | 0766029 | 4/1997 |

* cited by examiner

*Primary Examiner*—Thomas Denion
*Assistant Examiner*—Jaime Corrigan
(74) *Attorney, Agent, or Firm*—Bierman, Muserlian and Lucas

(57) ABSTRACT

The Invention concerns g solenoid valve, more particularly a proportional hydraulic valve which is arranged within a hydraulic system of a device for varying the valve timing of gas exchange valves in an internal combustion engine. The solenoid valve (1) generally comprises an electromagnet (2) having a hollow cylindrical magnet housing (3), at least one coil winding (4) and an armature (5) as Well as a first pole shoe (6) and a second pole shoe (7) and further comprises a valve member (8) having a hollow cylindrical valve housing (9) for receiving a spool valve which is displaceable relative to the valve housing (9) by the armature (5) of the electromagnet (2). According to the invention, the electromagnet (2) and the valve member (8) are connected and fixed radially and axially to each other by force locking and/or positive engagement by the second pole shoe (7) of the electromagnet (2) which is arranged adjacent the valve member (8) and configured as a plug-in lock for the valve housing (9).

5 Claims, 2 Drawing Sheets

SOLENOID VALVE, PARTICULARLY A PROPORTIONAL HYDRAULIC VALVE

FIELD OF THE INVENTION

The present invention relates to a solenoid valve, more particularly to a proportional hydraulic valve, which is installed within a hydraulic system of a device for varying valve timing of gas exchange valves In an Internal combustion engine, said solenoid valve generally comprising:

an electromagnet having a magnet housing, at least one coil winding, an armature, a first pole shoe and a second pole shoe, and a valve member having a hollow cylindrical valve housing for receiving a spool valve that is displaceable relative to the valve housing by the armature of the electromagnet.

BACKGROUND OF THE INVENTION

A generic solenoid valve of the pre-cited type is known from DE 4 228 045 A1. This solenoid valve generally comprises an electromagnet having a hollow cylindrical magnet housing, a coil winding, an armature, a first and a second pole shoe, and further comprising a valve member having a likewise hollow cylindrical valve housing for receiving a spool valve that Is displaceable relative to the valve housing by the armature of the electromagnet. The connection between the electromagnet and the valve member is effected with the help of a bottom of the magnet housing adjacent the valve member. This bottom has a central aperture into which a flange of the valve housing is introduced so that the valve housing is suspended from the magnet housing to project outwards therefrom, The valve member is then force-locked and positively engaged with the bottom of the magnet housing by a first pole shoe which is mounted in the magnet housing and by the coil winding, the second pole shoe and a cap of the electromagnet.

Another possibility of connecting the electromagnet and the valve member of a solenoid valve is known from DE 4 423 122 A1. In this solenoid valve, which is basically made up of the same elements the valve housing likewise comprises a flange which bears against a pole shoe of the electromagnet that at the same time constitutes the bottom of the magnet housing. For fixing the valve member on the electromagnet, the magnet housing of the electromagnet has an extension whose edge portion adjacent the valve member is bent round to surround the flange of the valve housing so that the valve member is likewise fixed on the electromagnet by force-locking and positive engagement.

The drawings of EP 0 212 458 further disclose that in a solenoid valve, the bottom of the magnet housing of the electromagnet has a hollow cylindrical extension coaxial to the valve member, and the outer peripheral surface of this extension comprises a thread. The valve housing of the valve member in this solution likewise comprises a flange. A union nut is slipped onto the valve housing and supported on this flange and then screwed onto the extension of the magnet housing of the electromagnet so that the valve member is force-locked to the electromagnet.

A drawback of these prior art solenoid valves is that the connections between the electromagnets and the valve members are relatively complicated to manufacture and cost-intensive and do not effect an adequate radial fixing for assuring the required exact alignment between the bore of the valve housing for receiving the spool valve and the armature of the electromagnet. Additionally, these prior art connections between the electromagnet and the valve member are not stable enough to exclude the danger of detrimental effects on the bore of the valve housing for the spool valve during assembly and operation of the solenoid valve. Moreover, these connections are often subjected to considerable loads which, in the case of less stable connections, cause a loosening or a disengagement of the valve member from the electromagnet, and the resulting axial offset between the bore for the spool valve and the armature of the electromagnet leads to a failure of the solenoid valve. Further, if the connection between the electromagnet and the valve member of the solenoid valve is too tight, the high forces of assembly can cause deformation Of the bore for the spool valve In the valve housing which can lead to a binding of the spool valve in the bore and, thus also, to a failure of the solenoid valve.

OBJECTS OF THE INVENTION

It is therefore an object of the invention to provide a solenoid valve, more particularly a proportional hydraulic valve, in which the connection between the electromagnet and the valve member is characterized by low manufacturing and assembly costs while, at the same time, offering good facilities for a radial fixing of the valve member on the electromagnet.

Another object of the invention is to exclude detrimental effects on the bore for the spool valve in the valve housing during assembly and operation of the solenoid valve to the greatest possible extent.

These and other objects and advantages of the invention will become obvious from the following detailed description.

SUMMARY OF THE INVENTION

The invention achieves the above objects by the fact that the electromagnet and the valve member are connected and fixed radially and axially to each other by force-locking and/or positive engagement with the help of the second pole shoe of the electromagnet that is arranged adjacent the valve member and is configured as a plug-in lock for the valve housing.

According to one advantageous feature of the Invention, the second pole shoe of the electromagnet comprises, adjacent the valve member, a preferably hollow cylindrical, coaxial extension which is configured on the inside as a plug-in lock for the valve housing of the valve member and is thin-walled at least in its free, circumferential edge portion. Such a plugged connection enables an exact radial fixing of the entire valve member before it is connected to the electromagnet, to that the required exact alignment of the bare for the spool valve In the housing to the armature of the electromagnet is assured.

In a particularly advantageous first embodiment of the connection of the electromagnet to the valve member, an end region of the valve member adjacent the electromagnet preferably comprises a circumferential annular groove and the electromagnet Is connected to the valve member by a toothed clamping-In of the thin-walled edge portion of the extension of the second pole shoe into this annular groove. For this purpose, a toothed matrix having a diameter of a dimension between the outer diameter of the valve housing and the outer diameter of the thin-welled edge portion of the extension of the second pole shoe is moved in axial or radial direction over the valve housing toward the electromagnet. When the matrix strikes the thin-walled edge portion of the extension of the second pole shoe, this edge portion is pressed into the circumferential annular groove arranged in the end region of the valve housing. At the same time, the valve housing is pressed against a support surface in the extension of the second pole shoe so that, upon an unloading of the parts concerned, the pole shoe and the valve housing are braced axially against each other, Due to the toothing of the crimped connection, the thin-walled edge portion of the extension of the pole shoe is pressed deeper into the annular groove of the valve housing in tho region of the teeth than in the region of the gaps between the teeth so that the valve member is prevented at the same time from rotating relative to the electromagnet. As an alternative to this connection with the help of a crimping matrix, a similar connection between the electromagnet and the valve member can also be made by press crimping.

In an equally advantageous second embodiment of the connection of the electromagnet to the valve member, an end region of the valve housing adjacent the electromagnet is configured preferably with two circumferential annular grooves and the edge portion of the extension of the second pole shoe is rolled Into these annular grooves thus connecting the electromagnet to the valve member. For this purpose, the thin-walled edge portion of the extension of the pole shoe of the electromagnet is pressed into the annular grooves of the valve housing by a shaping tool during a rotary motion of the electromagnet and the valve member, or also of the shaping tool. In this embodiment, too, the valve housing is pressed at the same time against a support surface in the extension of the pole shoe so that after the unloading of the parts concerned, the pole shoe and the valve housing are braced axially against each other. A separate anti-rotation device between the valve member and the electromagnet has proved to be unnecessary In this type of connection because the double pressing of the edge portion of the extension of the pole shoe into the two annular grooves of the valve housing results in a force-locking that effectively prevents rotation. The arrangement of two annular grooves on the valve housing, however, Is only one preferred embodiment and does not exclude the provision of more or less than two annular grooves and the resulting multiple or single rolled-in connection between the electromagnet and the valve member.

Finally, in a third advantageous embodiment of the connection of the electromagnet to the valve member, the valve housing Is configured preferably with a plurality of cavities in an end region adjacent the electromagnet, and the electromagnet is connected to the valve member by a localized swaging of the edge portion of the extension of the second pole shoe Into these cavities. These cavities may be made as radial pocket or through-bores in the valve housing in any desired number and may be arranged symmetrically or asymmetrically in one or more circumferential lines around the periphery of the end region of the valve housing adjacent the electromagnet. The thin-walled edge portion of the extension of second pole shoe is then pressed with the help of a die at appropriate points into these cavities in the valve housing, while the valve housing is pressed at the same time against a support surface in the extension of the pole shoe. Thus, after the unloading of the parts concerned, both an axial bracing between the pole shoe and the valve housing and a prevention of rotation of the valve member relative to the electromagnet are obtained. A similar connection of the valve member to the electromagnet can be made in a modified form of this embodiment in which the edge portion of the extension of the second pole shoe is swaged to the valve housing without the provision of separate cavities in the valve housing.

The solenoid valve of the invention, particularly a proportional hydraulic valve, has the advantage, in all its proposed embodiments, over the prior art solenoid valves that the connection between the electromagnet and the valve member can be established by a simple chipless shaping of the thin-walled edge portion of the coaxial extension of the pole shoe situated adjacent the valve member. Since, in addition, this pole shoe can be made as a low-cost extrusion molded part the connection of the invention is characterized in that it has the lowest possible manufacturing and assembly costs as well as optimum strength properties. At the same time, due to the plug-in lock configured on the inner side of the extension of the pole shoe adjacent the valve member, an advantageous possibility of a radial fixing of the valve member on the electromagnet is created 8o that detrimental effects on the reception bore for the spool valve in the valve housing during assembly and operation of the solenoid valve are largely excluded. A further advantage of the solenoid valve of the invention, finally, is that, due to the type of connection between the electromagnet and the valve member, the hitherto mostly required fixing shoulder of enlarged diameter on the valve housing can now be omitted, so that the valve housing, too, can be manufactured economically with a continuous outer diameter.

The invention will now be described more closely with reference to a few examples of embodiment represented in the appended drawings.

DETAILED DESCRIPTION OF THE DRAWINGS

Figure 1:
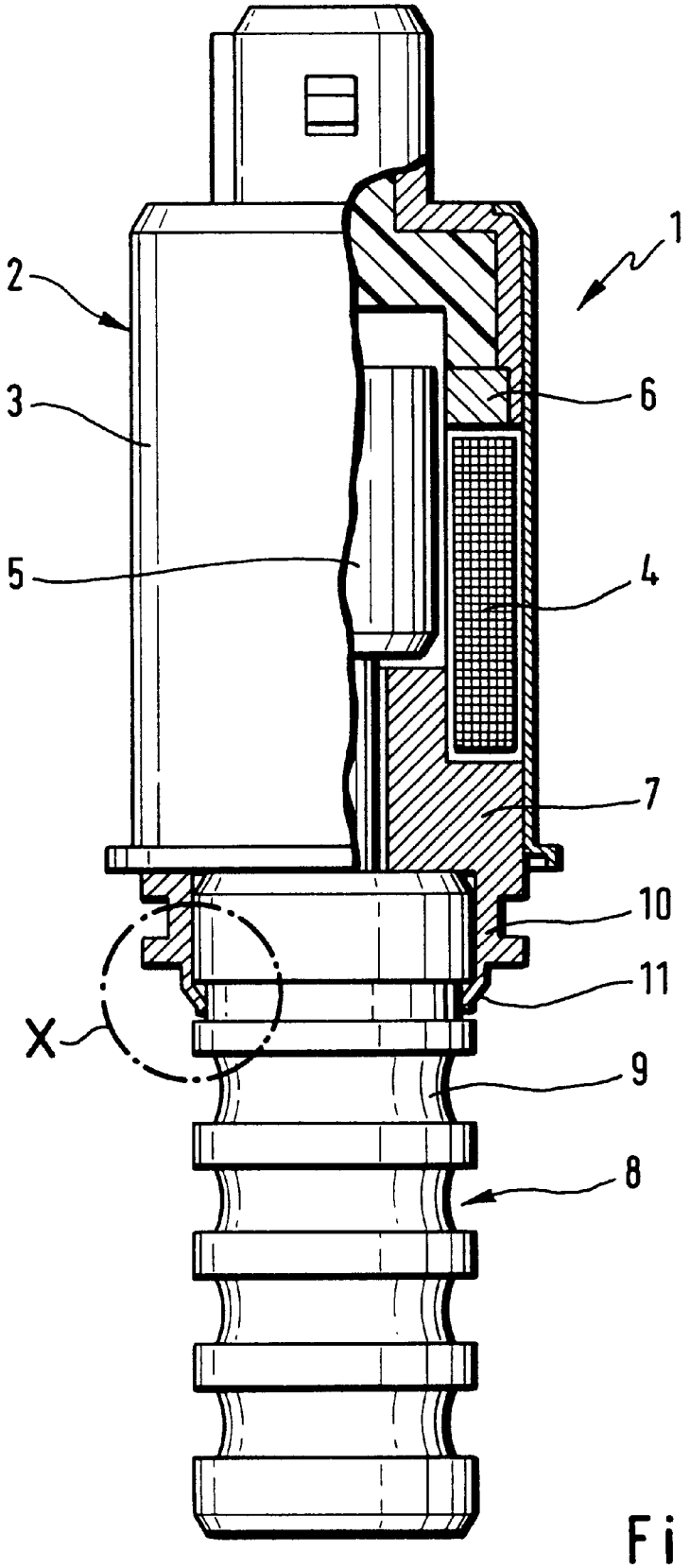
FIG. 1 is an overall view of a solenoid valve of the invention showing the electromagnet in partial section.

FIG. 1 clearly shows a solenoid valve 1 configured as a proportional hydraulic valve of a type used, for example, in a hydraulic system of a device for varying the valve timing of gas exchange valves in an internal combustion engine. This solenoid valve 1 comprises an electromagnet 2 and a hollow cylindrical magnet housing 3 in which are lodged a coil winding 4, an armature 5 as well as a first pole shoe 6 and a second pole shoe 7. The solenoid valve 1 further comprises a valve member 8 having a likewise hollow cylindrical valve housing 8 for receiving a spool valve, not shown, which is movable relative to the valve housing 9 by the armature 5 of the electromagnet 2.

In order to obtain a simply and economically realizable connection and a radial fixing between the electromagnet 2 and the valve member 8 of the solenoid valve 1, according to the provisions of the Invention, the electromagnet 2 and the valve member 8 are force-locked and/or positively engaged with each other while being radially and axially fixed relative to each other with the help of the second pole shoe 7 of the electromagnet 2 that is arranged adjacent the valve member 8 while being configured as a plug-in lock for the valve housing 9. It can be clearly seen in FIG. 1 that, for this purpose, the second pole shoe 7 of the electromagnet 2 comprises on Its end nearer the valve member 8, a hollow cylindrical coaxial extension 10 which is configured on the inside as a plug-in lock for the valve housing 9 of the valve member 8 and has a fee, thin-welled peripheral edge portion 11.

Figure 2:
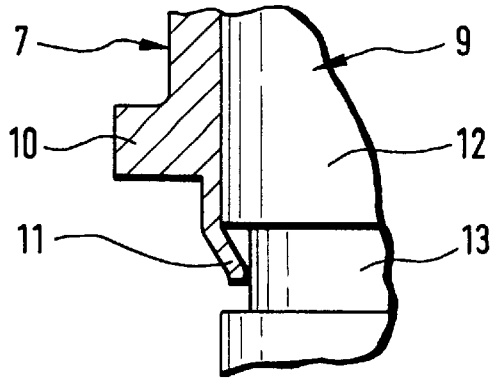
FIG. 2 is an enlarged representation of the detail X of FIG. 1 showing a first embodiment of the connection between the electromagnet and the valve member.

A first embodiment of a connection made according to the invention between the electromagnet 2 and the valve member 8 is shown in an enlarged representation of the detail X in FIG. 2. In this embodiment, the valve housing 9 has, in its and region 12 adjacent the electromagnet 2, a circumferential annular groove 13 which, after the insertion of the valve member 8 into the extension 10 of the second pole shoe 7, is situated approximately at the same level as the thin-walled edge portion 11 of the extension 10 of the pole shoe 7. Thus, by using a toothed matrix, the electromagnet 2 can be connected to the valve member 8 by a toothed crimping-in of the edge portion 11 of the extension 10 of its second pole shoe 7 into the annular groove 13 of the valve housing 9.

Figure 3:
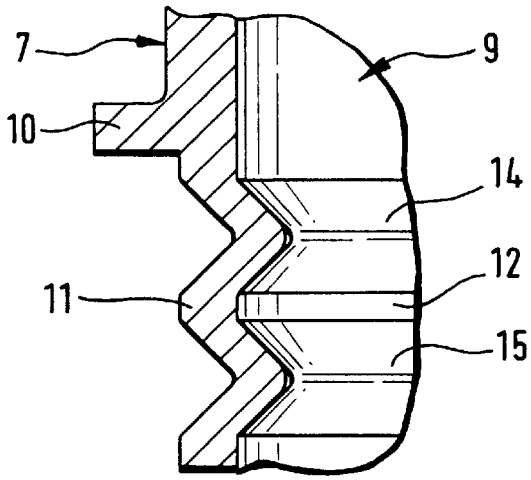
FIG. 3 is an enlarged representation of the detail X of FIG. 1 showing a second embodiment of the connection between the electromagnet and the valve member.

The enlarged representation of the detail X in FIG. 3 shows a second embodiment of a connection made according to the invention between the electromagnet 2 and the valve member 8. In this embodiment, the valve housing 9 has, in its end region 12 adjacent the electromagnet 2, two circumferential annular grooves 14, 15 which have a wedge-shaped cross-section and which, after the insertion of the valve member 8 into the extension 10 of the second pole shoe 7, are surrounded by the thin-walled edge portion 11 of the extension 10. Thus, with the help of a rotating shaping tool, the electromagnet 2 can be connected to the valve member 8 by a rolling of the edge portion 11 of the extension 10 of the second pole shoe 7 into these annular grooves 14, 15.

Figure 4:
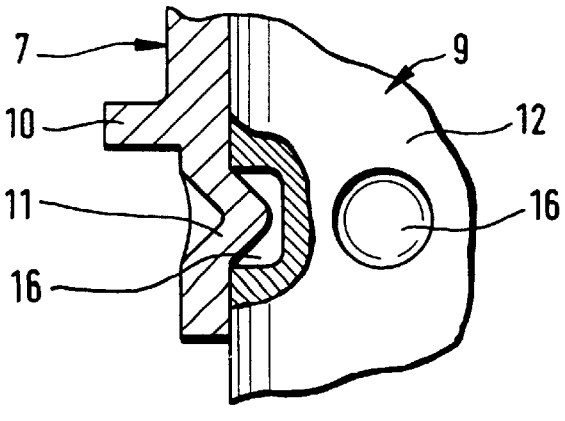
FIG. 4 is an enlarged representation of the detail X of FIG. 1 showing a third embodiment of the connection between the electromagnet and the valve member.

The enlarged representation of the detail X In FIG. 4 shows a third embodiment of a connection made according to the invention between the electromagnet 2 and the valve member 8. It can be clearly seen that in this embodiment, the valve housing 9 comprises, In Its end region 12 adjacent the electromagnet 2, a plurality of radial cavities 16 which are configured as pocket bores and arranged symmetrically on one circumferential line and which, after the insertion of the valve member a Into the extension 10 of the second pole shoe 7. Are surrounded by the thin-walled edge portion 11 of the extension 10. Thus, the electromagnet 2 can be connected to the valve member 8 by a localized swaging of the edge portion 11 of the extension 10 of the second pole shoe 7 Into these cavities 16.

What is claimed is:

1. A solenoid valve configured as a proportional hydraulic valve and arranged within a hydraulic system of a device for varying valve timing of gas exchange valves in an internal combustion engine, said solenoid valve comprising:

an electromagnet having a hollow cylindrical magnet housing, at least one coil winding an armature, a first pole shoe and a second pole shoe, and a valve member having a hollow cylindrical valve housing for receiving a spool valve which is displaceable relative to the valve housing by the armature of the electromagnet, wherein:

the electromagnet and the valve member are connected and fixed radially and axially to each other by at least one of force-locking and positive engagement by the second pole shoe of the electromagnet, which second pole shoe is arranged adjacent the valve member and is configured as a plug-in lock for the valve housing.

2. A solenoid valve of claim 1 wherein the second pole shoe of the electromagnet comprises, adjacent the valve member, a hollow cylindrical, coaxial extension which is configured on an inside as a plug-in lock for the valve housing of the valve member and is thin-walled at least In a tree, peripheral edge portion.

3. A solenoid valve of claim 2 wherein an end region of the valve housing adjacent the electromagnet comprises a circumferentially extending annular groove and the electromagnet is connected to the valve member by a toothed crimping-in of the edge portion of the extension of the second pole shoe into said annular groove.

4. A solenoid valve of claim 2 wherein an end region of the valve housing adjacent the electromagnet comprises two circumferential annular grooves and the electromagnet is connected to the valve member by a rolling of the edge portion of the extension of the second pole shoe into said two annular grooves.

5. A solenoid valve of claim 2 wherein an end region of the valve housing adjacent the electromagnet comprises a plurality of radial cavities and the electromagnet is connected to the valve member by a localized swaging of the edge portion of the extension of the second pole shoe into said cavities.

* * * * *